United States Patent [19]
Holland et al.
[11] 3,946,261
[45] Mar. 23, 1976

[54] DUAL FILAMENT X-RAY TUBE

[75] Inventors: William P. Holland, West Redding; Capleton I. Swanson, Bridgeport; Jacob A. Randmer, Wilton, all of Conn.

[73] Assignee: The Machlett Laboratories, Inc., Stamford, Conn.

[22] Filed: Jan. 3, 1975

[21] Appl. No.: 538,276

[52] U.S. Cl. ..... 313/56; 313/57; 313/346 R
[51] Int. Cl.[2] ..... H01J 35/06
[58] Field of Search ..... 313/56, 346 R

[56] References Cited
UNITED STATES PATENTS 1,986,466 1/1935 Ehrke ..... 313/56
2,764,706 9/1956 Atlee ..... 313/56

*Primary Examiner*—R. V. Rolinec
*Assistant Examiner*—Darwin R. Hostetter
*Attorney, Agent, or Firm*—John T. Meaney; Joseph D. Pannone; Harold A. Murphy

[57] ABSTRACT

An X-ray tube including a tubular envelope having therein two cathode filaments operatively disposed in spaced relationship with an anode target surface, one filament being made of a material suitable for low current operation and the other filament being made of a material suitable for high current operation of the X-ray tube.

8 Claims, 3 Drawing Figures

DUAL FILAMENT X-RAY TUBE

Background Of The Invention

This invention relates generally to X-ray apparatus and is concerned more particularly with an X-ray tube having a plurality of cathode filaments made of respective materials suitable for associated operating levels of the tube.

An X-ray tube of the dual filament type generally comprises a tubular envelope having therein an anode target surface supported in spaced opposing relationship with a pair of separately operable filaments, one of which usually is larger in diameter and longer than the other. The larger filament generally is used to obtain a substantially greater electron emission than provided by the smaller filament. Consequently, the higher electron beam current emitted from the larger filament impinges on a relatively larger area of the target surface and generates a higher flux X-ray beam, which is suitable for providing short time, motion arresting exposures of a beating heart, for example. On the other hand, the smaller filament directs a comparatively low current, electron beam onto a correspondingly small area of the target surface to generate a lower flux X-ray beam having higher resolution, which is suitable for cineradiography, for example.

Thus, each of the filaments is operated under respective conditions to provide a suitable current level, electron beam for generating an associated X-ray beam having desired properties for special X-ray techniques. However, despite the diversity in operating conditions, both of the filaments usually are made of the same material. As a result, it may be found that a filament material which functions satisfactorily in the low temperature range poses problems at relatively higher operating temperatures. Similarly, a filament material which provides suitably high electron currents in the high temperature range may be found to perform erratically at relatively low operating temperatures.

Therefore, it is advantageous to provide a dual filament, X-ray tube with filaments made of respective materials suitable for performing satisfactorily at associated operating levels of the tube.

Summary Of The Invention

Accordingly, this invention provides an X-ray tube comprising a tubular envelope having therein an anode target surface disposed in spaced opposing relationship with a pair of helically wound filaments made of respective different materials. One of the filaments is made of thoriated tungsten material and, preferably, is of greater diameter and length than the other filament which is made of substantially pure tungsten material. The thoriated tungsten filament may be carburized, in a conventional manner, to a depth of about 20 to 30 percent of its cross-sectional area in order to improve emission characteristics. The pure tungsten filament is limited to a maximum operating temperature of about 2400° centigrade where it produces an electron current of approximately 1600 milliamperes per square centimeter of emitting surface. At higher operating temperatures, the pure tungsten material evaporates very rapidly and may deposit on dielectric support members which may result in voltage breakdown of the tube.

The thoriated tungsten filament, on the other hand, emits an equivalent electron current at a temperature of about 1650° centigrade. Furthermore, the thoriated tungsten filament may be operated safely at a temperature of about 1700° centigrade for extended intervals of time to produce an electron current of approximately 3000 milliamperes per square centimeter of emitting surface. Evaporation of tungsten or other materials from the thoriated tungsten filament at these temperatures is very small, typically about two hundred thousand times less than the evaporation of tungsten from the pure tungsten filament at 2400° centigrade. Thus, the thoriated tungsten filament is especially suited for emitting relatively high electron currents in the high temperature range of operation without risk of damaging the X-ray tube. However, when the thoriated tungsten filament is operated at relatively low temperatures, the emission may be affected by the relatively low diffusion rate of the thorium to the surface to ensure a predictable electron current level. Consequently, in the low temperature range of operation, the performance of the thoriated tungsten filament is not repeatable with a consistency characteristic of the pure tungsten filament.

Therefore, in accordance with this invention, the pure tungsten filament, preferably, is operated to achieve electron current levels in the range from below three milliamperes up to about nine hundred milliamperes, as desired. The thoriated tungsten filament, preferably, is operated when current levels from 900 milliamperes to more than 3000 milliamperes are desired. Each of the filaments may be suitably disposed in respective focusing cups for directing the associated beams of electrons onto aligned focal spot areas of the anode target surface. Thus, the electron beam emanating from the smaller filament may be focused to produce a correspondingly small focal spot, such as six tenths of a square millimeter in size, for example, to provide an associated X-ray beam having high resolution properties. Also, the electron beam emanating from the larger filament may be focused to produce a relatively larger focal spot, such as greater than one square millimeter in size, for example, to provide associated high flux X-ray beam.

BRIEF DESCRIPTION OF THE DRAWINGS

For a better understanding of this invention, reference is made in the following more detailed description to the accompanying drawing wherein.

DESCRIPTION OF THE PREFERRED EMBODIMENT

Figure 1:
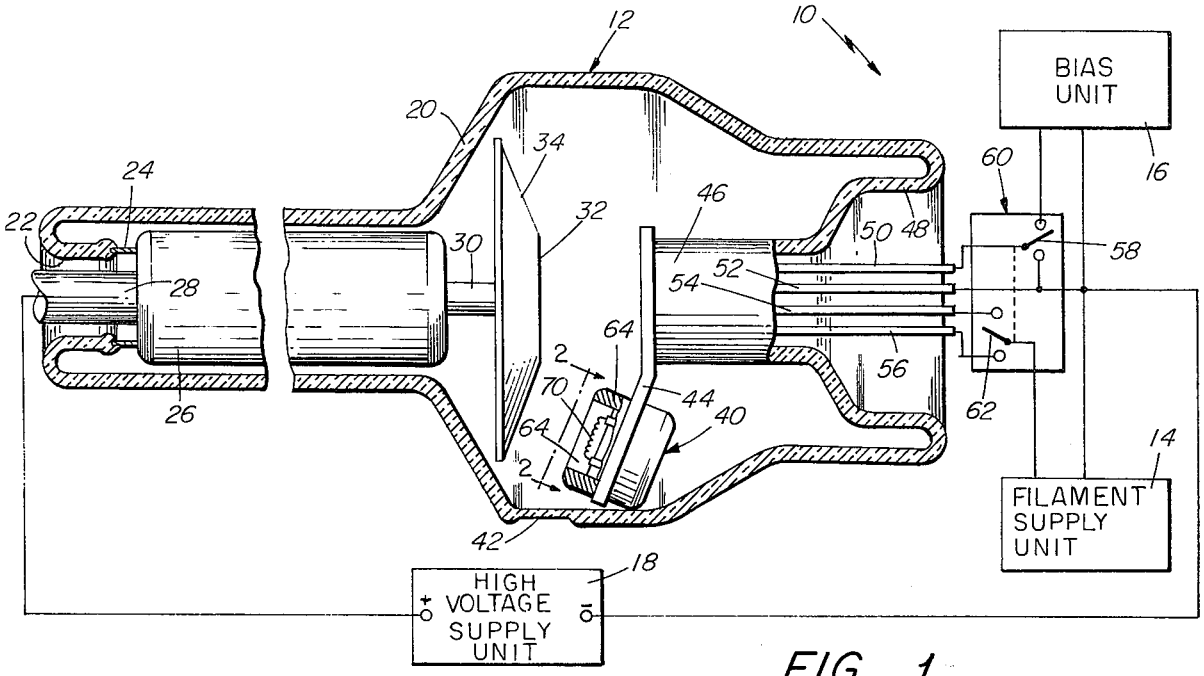
FIG. 1 is an axial view, partly in section, of an X-ray tube and apparatus embodying the invention.

Referring more particularly to the drawing wherein like characters of reference designate like parts, there is shown in FIG. 1 X-ray generating apparatus 10 including an X-ray tube 12 operatively connected to an adjustable filament supply unit 14, an adjustable biasing unit 16, and a high voltage supply unit 18.

X-ray tube 12 comprises a generally tubular envelope 20 which may be made of dielectric material, such as lead-free glass, for example. One end of envelope 20 is provided with a reentrant portion 22 which is peripherally sealed to one end of a metal collar 24. The other end of collar 24 is hermetically attached, in a well-known manner to one end of a conventional anode rotor 26, which is made of conductive material, such as copper, for example. A stem 28 of rotor 26 extends externally of the envelope 20 and provides terminal means for electrically connecting the rotor 26 to a positive terminal of the adjustable high voltage supply unit 18.

Within envelope 20, a conductive shaft 30 made of refractory material, such as molybdenum, for example, extends longitudinally from the internal end of rotor 26 and is in electrical communication therewith. Fixedly attached to the distal end portion of shaft 30 is a perpendicularly disposed anode disk 32 which is rotated by the shaft 30 in a well-known manner. The inner end of disk 32 has a frusto-conical configuration for providing a sloped annular target surface 34 adjacent its outer periphery. The target surface 34 is made of a material, such as tungsten, for example, which readily emits X-rays when bombarded by high energy electrons. However, other portions of anode disk 32 may be made of suitable conductive material, such as molybdenum, for example.

Although anode disk 32 is rotatable, a portion of the target surface 34 is continuously positioned in spaced opposing relationship with a cathode head 40 and is sloped toward a radially aligned, X-ray transparent window 42 in the envelope 20. The cathode head 40 is fixedly supported on a suitably angled, end portion of a hollow arm 44 which has an opposing end portion fixedly attached to one end of an axially disposed support cylinder 46. The other end of support cylinder 46 is circumferentially sealed to a reentrant portion 48 of envelope 20, out of which hermetically extend electrical terminal lead members 50, 52, 54, and 56, respectively.

Terminal lead member 50 is electrically connected to a movable contact arm 58 of a gang switching means 60. The arm 58 may be operated to engage a fixed contact which is electrically connected to an output terminal of the adjustable biasing unit 16. Alternatively, the arm 58 may be operated to engage a fixed contact which is electrically connected to the terminal lead member 52. Terminal lead member 52 also is connected electrically to an output terminal of the filament supply unit 14 and the negative output terminal of the high voltage supply unit 18. The movable contact arm 58 is mechanically coupled to another movable contact arm 62 of gang switching means 60, such that both movable arms are actuated simultaneously. Thus, when the movable contact arm 58 is electrically connected to the biasing unit 16, the movable arm 62 engages a fixed contact which is electrically connected to terminal lead member 54. Alternatively, when the movable contact arm 58 is electrically connected to terminal lead member 52, the movable arm 62 engages a fixed contact which is electrically connected to a terminal lead member 56. Within envelope 20, the terminal lead members 50, 52, 54, and 56, respectively, extend through the hollow arm 44 ad into the cathode head 40.

Figure 3:
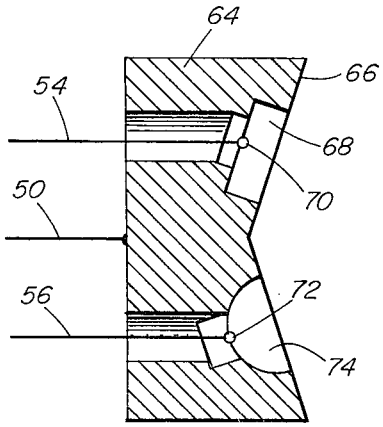
FIG. 3 is an axial sectional view taken along the line 3—3 in FIG. 2 and looking in the direction of the arrows.
Figure 2:
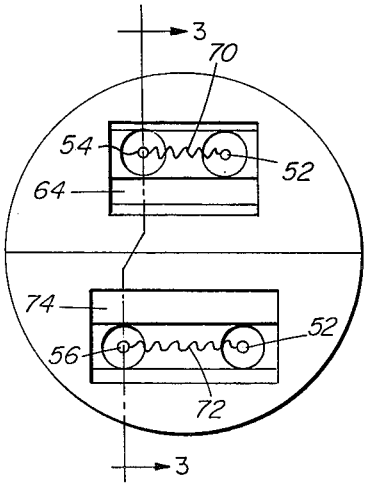
FIG. 2 is an enlarged plan view of the cathode head shown in FIG. 1, taken along the line 2—2 and looking in the direction of the arrows.

As shown in FIGS. 2 and 3, cathode head 40 includes a cylindrical block 64 made of conductive material, such as nickel, for example, which is electrically connected to the terminal lead member 50. The block 64 is provided with a substantially V-shaped end surface 66 which is disposed in spaced opposing relationship with an aligned portion of the anode target surface 34. Symmetrically disposed in one of the inclined faces of end surface 66 is an elongated stepped cavity 68 having insulatingly supported therein a helically wound filament 70. The filament 70 extends longitudinally within cavity 68, and is made of substantially pure tungsten material. One end of filament 70 is electrically connected to terminal lead member 54, and the opposing end is electrically connected to terminal lead member 52.

The filament 70 preferably is shorter in length and smaller in diameter than another helically wound filament 72 which is insulatingly supported within an elongated arcuate bottomed cavity 74 symmetrically disposed in the other inclined face of end surface 66. The filament 72 extends longitudinally within the cavity 74, and is made of thoriated tungsten material comprising substantially pure tungsten material to which has been added about one percent thorium oxide. Prior to assembly into the tube or prior to evacuation of the complete tube, the larger thoriated filament is carburized, in a conventional manner, to a depth of about twenty to thirty percent of the cross-sectional area. During operation of the tube 12, the thorium oxide is converted to metallic thorium which diffuses to the filament surface at a predictable rate when the filament is operated at a sufficiently high temperature. Thus, when filament 72 is operated within a specified temperature range, the thorium on the surface of the filament is replenished to provide a copious emission of electrons therefrom. One end of filament 72 is electrically connected to terminal lead member 56, and the opposing end thereof is electrically connected to terminal lead member 52 in common with the corresponding end of the shorter filament 70.

For low electron beam currents, such as from below three milliamperes up to about nine hundred milliamperes, for example, the gang switching means 60 may be actuated to connect the filament supply unit 14 to the shorter tungsten filament 70 and to connect the conductive block 64 to the biasing unit 16. The filament supply unit 14 and the high voltage supply unit 18 may be adjusted, either automatically or manually, to respectively supply a suitable low current to the filament 70 and to establish a desired elctrostatic potential between the filament 70 and the target surface 34. As a result, the pure tungsten filament 70 is heated to the proper temperature for emitting the desired low electron current. The emitted electrons are drawn electrostatically toward the target surface 34 in a generally flat beam, which is focused onto a small area of target surface 34 by a biasing potential applied to the block 64. Thus, the stepped cavity 68, wherein the filament 70 is insulatingly disposed, functions as a focusing cup to provide a high resolution, X-ray beam which passes out of tube 12 through the X-ray transparent window 42 in envelope 20.

For high electron beam currents, such as from nine hundred milliamperes to above three thousand milliamperes, for example, the gang switching means 60 may be actuated to connect the filament supply unit 14 to the thoriated tungsten filament 72. As a result, the conductive block 64 is connected to the cathode potential through the terminal lead member 52. The filament supply unit 14 and the high voltage unit 18 are adjusted, either automatically or manually, to respectively supply a suitably high current to filament 72 and to establish a suitably high potential between filament 72 and target surface 34. Consequently, the thoriated tungsten filament 72 is heated to a sufficiently high temperature to emit the desired high current of electrons. The emitted electrons are drawn electrostatically to the target surface 34 in a generally flat beam having a larger rectangular cross-section than the beam associated with the shorter filament 70. The electrons emitted from filament 72 are directed out of the cavity 74 by the cathode potential applied to the conductive block 64. Thus, the cavity 74 also functions as a focusing cup to aid in directing the emitted electrons onto a desired rectangular area of the sloped target surface. Accordingly, this high current electron beam generates a correspondingly high flux X-ray beam which passes out of tube 12 through the X-ray transparent window 42 and envelope 20.

Thus, there has been disclosed herein an X-ray tube 12 having the capability of providing electron beam currents from below three milliamperes in value to above three thousand milliamperes. The gang switching means 60 is actuated to avoid the operating the smaller filament 70 in the high electron current operating range where the pure tungsten material may evaporate very rapidly and short out the tube. The gang switching means 60 also is actuated to avoid operating the larger filament 72 in the low electron current operating range where the thoriated tungsten material may not be heated to a sufficiently high temperature to provide consistently repeatable emission currents.

Alternatively other means may be used for ensuring that the pure tungsten filament is used for producing low electron beam currents and the thoriated tungsten filament is operated to provide high electron beam currents. For example, the filaments may be connected to respective filament transformers which are adjustable independently of one another. Also, the filaments may be suitably supported in unbiased focusing cups, or other electron optical means may be employed for focusing purposes, such as apertured disks, for example. Also, the filaments 70 and 72, respectively, need not be helically wound, but instead may comprise respective straight strands of filament wire, or flat ribbons which may be shaped to aid in focusing emitted electrons, for examples.

From the foregoing, it will be apparent that all of the objectives of this invention have been achieved by the structures shown and described herein. It also will be apparent, however, that various changes may be made by those skilled in the art without departing from the spirit of the invention as expressed in the appended claims. It is to be understood, therefore, that all matter shown and described herein is to be interpreted as illustrative and not in a limiting sense.

What we claim is:

1. An X-ray tube comprising:
an envelope
an anode having a target surface disposed within the envelope; and
cathode means operatively spaced from the target surface and including a pair of separately operable, electron emitters for directing respective electron beams onto the target surface and generating associated X-ray beams, one of the emitters being made of thoriated tungsten material and the other being made of substantially pure tungsten material.

2. An X-ray tube as set forth in claim 1 wherein the emitters comprise respective helically wound filaments, the thoriated tungsten filament having a larger electron emitting surface than the pure tungsten filament.

3. An X-ray tube as set forth in claim 1 wherein the cathode means includes electrical means for energizing the thoriated tungsten filament to emit a higher electron current than emitted by the pure tungsten filament.

4. An X-ray tube as set forth in claim 3 wherein the cathode means includes electron focusing means operatively associated with the respective filaments for focusing electrons emitted therefrom onto respective focal spot areas of the target surface to generate the associated X-ray beams.

5. An X-ray tube as set forth in claim 4 wherein the electron focusing means includes means for focusing electrons emitted from the thoriated tungsten filament onto a larger focal spot area than the electrons emitted from the pure tungsten filament to generate a higher flux X-ray beam than produced by electrons from the pure tungsten filament.

6. An X-ray tube as set forth in claim 4 wherein the electron focusing means includes means for focusing electrons emitted from the pure tungsten filament onto a smaller focal spot area than electrons emitted from the thoriated tungsten filament to generate a higher resolution X-ray beam than produced by the electrons from the thoriated tungsten filament.

7. An X-ray tube as set forth in claim 4 wherein the electron focusing means comprises a pair of spaced focusing cups, each having a respective filament disposed therein.

8. An X-ray tube as set forth in claim 7 wherein the electron focusing means includes terminal means for applying respective electrical potentials to the focusing cups.

* * * * *